US006759581B2

(12) United States Patent
Taylor

(10) Patent No.: US 6,759,581 B2
(45) Date of Patent: Jul. 6, 2004

(54) ACOUSTIC STRINGED INSTRUMENT BODY WITH RELIEF CUT

(75) Inventor: Robert D. Taylor, El Cajon, CA (US)

(73) Assignee: Taylor-Listug, Inc., El Cajon, CA (US)

( * ) Notice: Subject to any disclaimer, the term of this patent is extended or adjusted under 35 U.S.C. 154(b) by 0 days.

(21) Appl. No.: 10/262,555

(22) Filed: Sep. 30, 2002

(65) Prior Publication Data

US 2004/0060418 A1 Apr. 1, 2004

(51) Int. Cl.[7] ..... G10D 3/00
(52) U.S. Cl. ..... 84/291; 84/274; 84/275; 84/267
(58) Field of Search ..... 84/291, 274, 267, 84/275, 192

(56) References Cited

U.S. PATENT DOCUMENTS

| | | | | | |
|---|---|---|---|---|---|
| 3,443,466 | A | * | 5/1969 | Brakewell | 84/291 |
| 3,561,314 | A | * | 2/1971 | MacEachron | 84/284 |
| 5,320,018 | A | * | 6/1994 | Fandrich | 84/195 |
| 6,177,622 | B1 | * | 1/2001 | Green | 84/453 |

* cited by examiner

*Primary Examiner*—Shih-Yung Hsieh
(74) *Attorney, Agent, or Firm*—Luce, Forward, Hamilton & Scripps; David E. Heisey

(57) ABSTRACT

An acoustic stringed instrument body includes a soundboard, a bottom surface and a side surface, wherein the soundboard includes a relief cut, wherein the relief cut is dimensioned to create a more flexible coupling between the soundboard and the sidewall, wherein the relief cut improves the tone of the instrument by allowing the soundboard to vibrate more freely.

20 Claims, 6 Drawing Sheets

ACOUSTIC STRINGED INSTRUMENT BODY WITH RELIEF CUT

FIELD OF THE INVENTION

The present invention is directed to instrument bodies, and more particularly, to acoustic stringed instrument bodies.

BACKGROUND OF THE INVENTION

Acoustic stringed instrument bodies like those on guitars, basses violins, cellos and the like have top surfaces called soundboards. These soundboards are typically made from wood and vibrate when the instrument is played. To provide an instrument with the most aesthetically pleasing tones, soundboards are usually tapered or feathered to thin the soundboard near its peripheral edge to allow more movement by the soundboard relative to the side wall of the instrument. However, tapering a soundboard is difficult and time consuming and frequently requires hours of hand sanding by a skilled craftsman to form a taper at the soundboard's edges which is not visually apparent.

One drawback associated with conventional soundboards involves the prohibitive costs of tapering a high quality instrument soundboard. Another drawback associated with conventional soundboards involves the use of wood as a soundboard material. Wood soundboards have a tendency to swell under humid conditions, causing changes in visual appearances and tonal quality. In addition, cracking can occur in wood soundboards under dry conditions.

In view of these drawbacks, there exists a need for an acoustic musical instrument soundboard that does not need to be tapered to achieve good tonal quality. There also exists a need for a wooden acoustic musical instrument soundboard that is robustly designed to be resistant to changes in atmospheric conditions such as humidity and temperature levels.

SUMMARY OF THE INVENTION

The present invention alleviates to a great extent the disadvantages of the prior art by providing an acoustic stringed instrument body including a soundboard with a relief cut around its periphery. The relief cut forms a more flexible coupling between the soundboard and the sidewall of the instrument, which improves the tone of the instrument.

One aspect of the present invention involves an acoustic stringed instrument body, including a soundboard, a bottom surface and a side surface, wherein the soundboard includes a relief cut to create a more flexible coupling between the soundboard and the sidewall thereby improving the tone of the instrument by allowing the soundboard to vibrate more freely.

Another aspect of the present invention involves an acoustic stringed instrument body, including a soundboard having an exterior surface, wherein a relief cut is located on the exterior surface close to the perimeter of the exterior surface.

A further aspect of the present invention involves an acoustic stringed instrument body, including a soundboard having an interior surface, wherein a relief cut is located on the interior surface close to the perimeter of the interior surface.

Yet another aspect of the present invention involves an acoustic stringed instrument body, including a soundboard having a relief cut with a semicircular, rectangular or triangular cross-section.

Another aspect of the present invention involves an acoustic stringed instrument body, including a back wall having a relief cut, wherein the relief cut in the back wall improves the tone of the instrument by allowing the back wall to vibrate more freely.

A further aspect of the present invention involves an acoustic stringed instrument body, including a soundboard is made of wood, wherein a relief cut in the soundboard permits stretching and contraction of the wooden soundboard due to changes in atmospheric conditions.

These and other features and advantages of the present invention will be appreciated from review of the following detailed description of the invention, along with the accompanying figures in which like reference numerals refer to like parts throughout.

DETAILED DESCRIPTION OF THE PREFERRED EMBODIMENTS

The following description involves an acoustic stringed instrument including a relief cut on the instrument body. The relief cut allows the body to vibrate more freely thereby improving the overall tone of the instrument. For purposes of describing the present invention, the acoustic stringed instrument including the invention is a guitar. However, as would be understood by one of ordinary skill in the art, the instrument may also comprise a bass, cello, violin, viola, sitar, mandolin or other acoustic stringed instrument.

Figure 1:
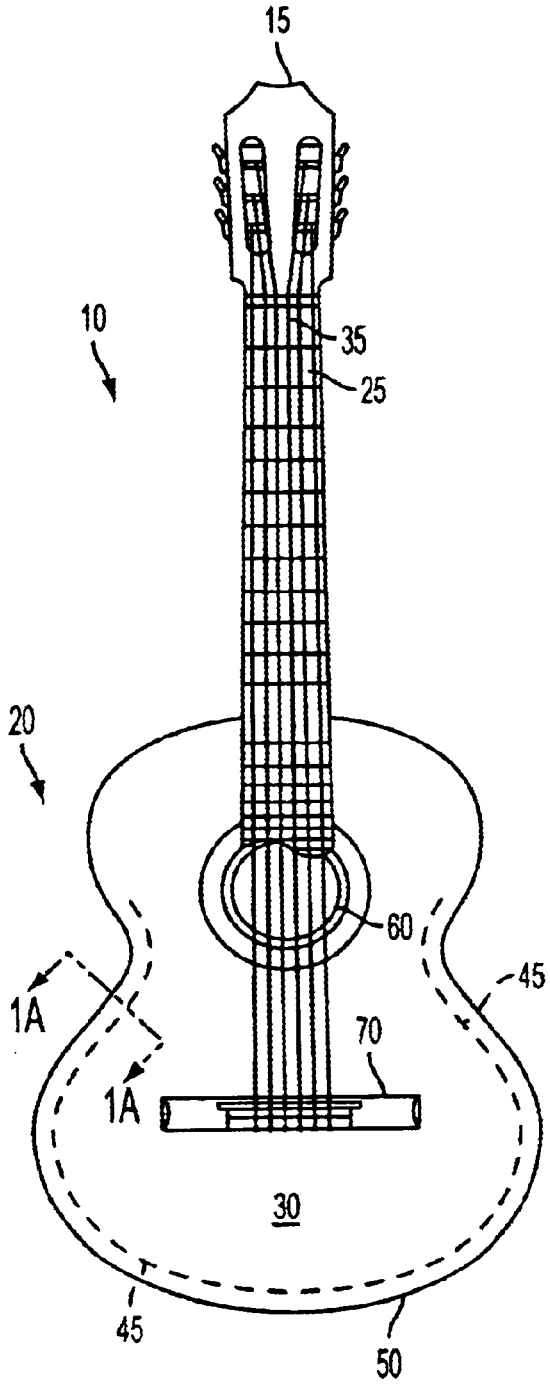
FIG. 1 is a front view of an embodiment of an assembly in accordance with the present invention.
Figure 2:
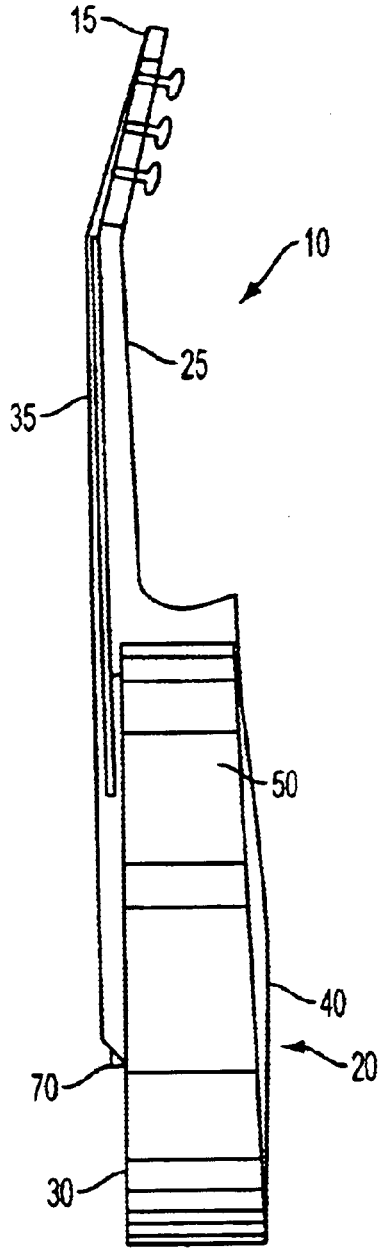
FIG. 2 is a side view of an embodiment of an assembly in accordance with the present invention.

FIGS. 1 and 2 show an acoustic stringed instrument 10 comprising a guitar 10 having a head 15, neck 25, strings 35 and guitar body 20. The guitar body 20 is a soundbox in the form of a hollow body having a gently inwardly curving waist of a conventional guitar. The guitar body 20 includes a soundboard 30 having a sound opening 60, a back wall 40 and a sidewall 50. The strings 35 extend from the head 15, along the neck 25, and over the sound opening 60 to a bridge 70 attached to the soundboard 30. In the embodiment depicted in FIGS. 1 and 2, the guitar body 20 is made of wood. According to other embodiments, the guitar body 20 may be made of plastic, graphite or other appropriate materials.

The vibration of the soundboard 30 and the back wall 40 greatly influence the tone of the instrument 10. As a general rule, the more freely the soundboard 30 and back wall 40 are able to vibrate, the louder and better the tone of the instrument 10. In conventional acoustic stringed instruments, the thickness of the instrument is on occasion tapered by hand sanding to allow freer movement between the soundboard and sidewall. Typically, during this expensive process, the thickness of the soundboard is tapered from its center to the periphery to improve the tone of the instrument. The tapering process is tedious and time consuming as the surface of the soundboard preferably has a flat appearance. For this reason the tapering or feathering is necessary done by hand by a skilled luthier. Errors in the tapering process can result in uneven tapering or undesirably this portions which can lead to cracking and breaking. In the past, luthiers have cautiously sanded the surface to produce a gradual taper extending over a large potion of the distance from the center to the peripheral edge.

Figure 3:
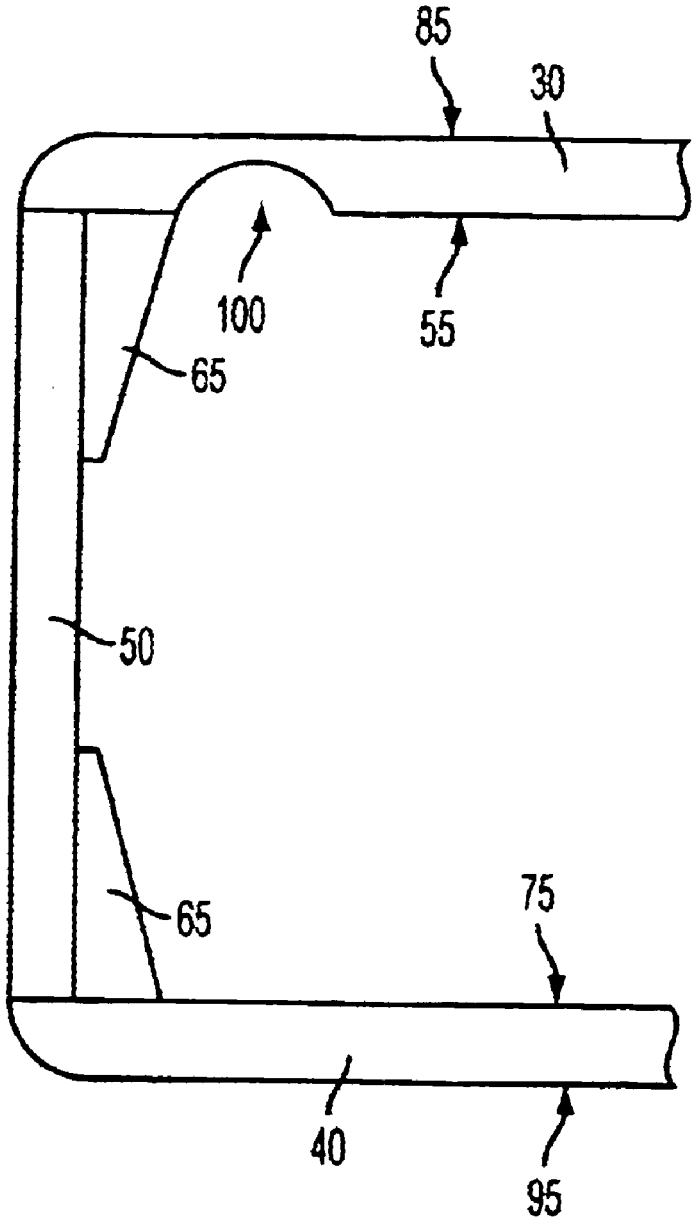
FIG. 3 is a cross-sectional view of FIG. 1 taken along line 1A—1A.
Figure 4:
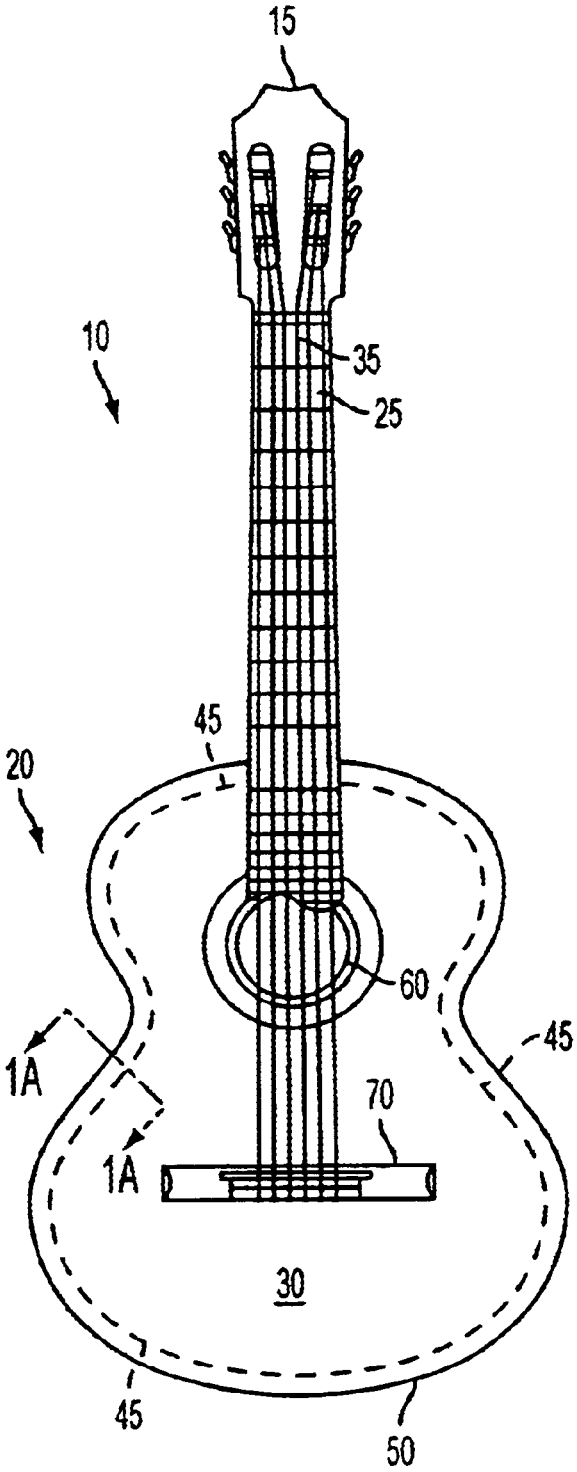
FIG. 4 is a front view of an embodiment of an assembly in accordance with the present invention.

According to the present invention, the time-consuming process of tapering the surface is replaced with the localized relief cut. Referring initially to FIG. 1, a dotted line 45 which follows the contour of the soundboard 30 is present inside of the perimeter of the soundboard 30. This dotted line 45 represents the general location of relief cuts 100,110,120, 130,140 and 150, which are located on the soundboard 30 and/or the back wall 40 of the instrument 10. As seen in FIG. 3, according to some embodiments, the soundboard 30 includes a relief cut 100 on its interior surface 55. The relief cut 100 preferably follows the shape of the soundboard 30 as it extends around the bridge 70 in close proximity to the sidewall 50. As best seen in FIG. 1, the dotted line 45, and hence the relief cut 100, appears on the portion of the soundboard 30 around the bridge 70, but does not extend around sound opening 60. However, as seen in FIG. 4, according to other embodiments, the dotted line 45 extends around the entire soundboard 30 just inside of the sidewall 50. While a single relief cut is shown and discussed, it is possible to add multiple relief cuts on a single surface to further adjust the strength and tonal qualities of the instrument. These cuts may have generally similar concentric shapes. They may also have differing shapes and dimensions.

One advantage of including relief cut 100 is the formation of a more flexible coupling between the soundboard 30 and the sidewall 50. A flexible coupling between the soundboard 30 and the sidewall 50 allows the soundboard 30 to vibrate more freely, improving the tone of the instrument 10. The use of a relief cut 100 eliminates or reduces the need to graduate the soundboard 30.

Another advantage of including relief cut 100 is the creation of a more robust soundboard 30 that is resistant to changes in atmospheric conditions such as humidity and temperature. The reduced thickness of the soundboard 30 at the relief cut 100 permits stretching and contraction due to changes in atmospheric conditions. Due to this increase in elasticity, the relief cut 100 may prevent cracking of the soundboard 30 during extreme changes in temperature and humidity.

As seen in FIG. 3, according to some embodiments, the relief cut 100 has a semicircular cross-section with a uniform surface area. According to other embodiments, the cross-sectional area of the relief cut 100 is varied in order to achieve different vibration tendencies and resulting tones. For example, the relief cut 100 may be machined to be deeper in areas around the bridge 70 and gradually shallower toward the sound opening 60, or vice versa.

With further reference to FIG. 3, the interior of the guitar body 20 includes kerfing 65, which increases the surface area for attachment of the soundboard 30 to the sidewall 50. Kerfing 65 is also employed to increase the surface area for attachment of the back wall 40 to the sidewall 50. The relief cut 100 is preferably located just inside of the kerfing 65. To achieve differing tonal qualities, the relief cut may be in other locations, including, for example closer to the sound hole. In some cases it may also be desirable to differ the distance the relief cut is from the sidewall depending on the location. For example it may be closer to the sidewall in the waist region and more remote in other areas or vive versa.

Figure 5:
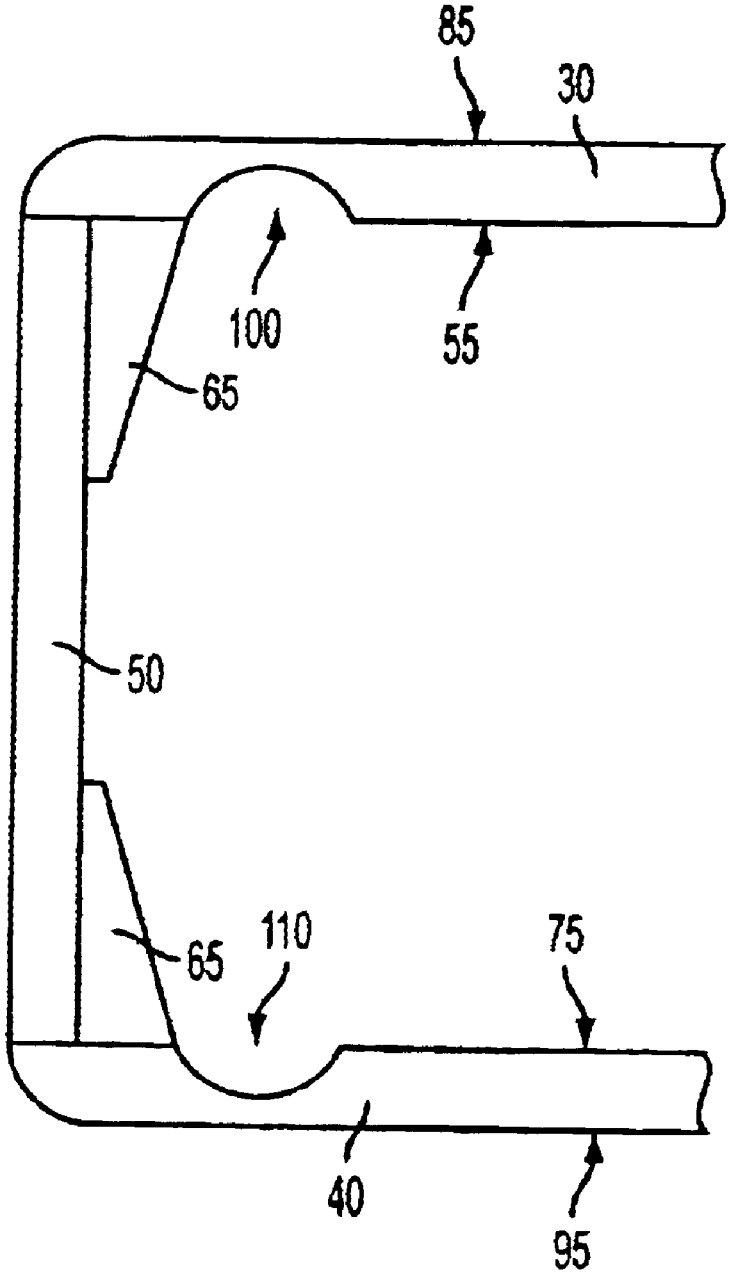
FIG. 5 is an alternative cross-sectional view of FIG. 1 taken along line 1A—1A.

As seen in FIG. 5, according to some embodiments, the back wall 40 of the instrument 10 also includes a relief cut 110 on its interior side 75, which extends along the back wall 40 just inside of kerfing 65 in a manner similar to the relief cut 100 in the soundboard 30. A relief cut 110 in the back wall 40 is desirable to create a more flexible coupling between the back wall 40 and the sidewall 50 to produce an instrument 10 with superior sound characteristics. The relief cut 110 has a semicircular cross-section with a uniform surface area. As would be understood by one of ordinary skill in the art, the cross-sectional area of the relief cut 100 may be varied along the soundboard 30 in order to achieve alternative sound qualities without departing from the scope of the present invention. As was the case for the soundboard, to achieve differing tonal qualities, the relief cut may be in other locations, including, for example closer to the center. In some cases it may also be desirable to differ the distance the relief cut is from the sidewall depending on the location. For example it may be closer to the sidewall in the waist region and more remote in other areas or vive versa.

Figure 6:
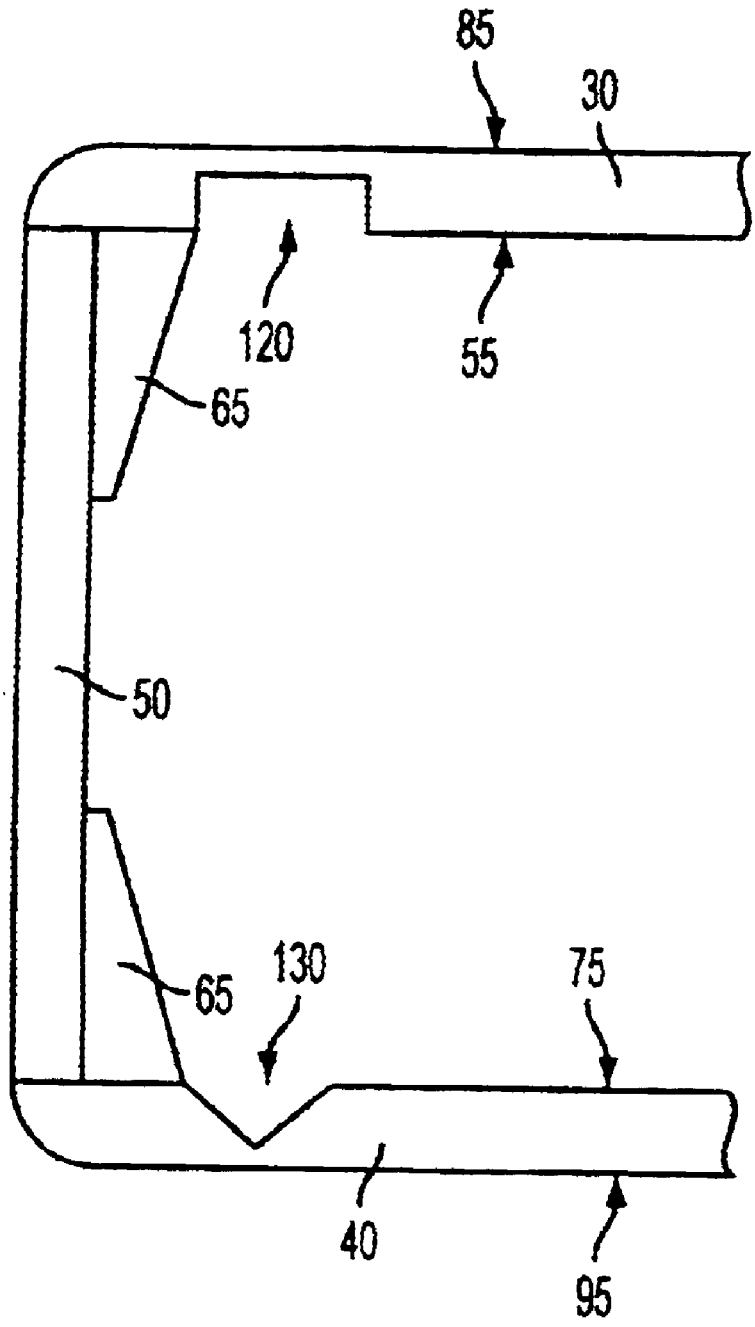
FIG. 6 is an alternative cross-sectional view of FIG. 1 taken along line 1A—1A.

As seen in FIG. 6, according to some embodiments, the soundboard 30 includes a relief cut 120 having a rectangular cross-section on its interior side 55 and the back wall 40 includes a relief cut 130 having a triangular cross-section on its interior side 75. Of course, as would be understood by one of ordinary skill in the art, the relief cuts 100,110,120, 130,140,150 may have other cross-sectional shapes such as square, elliptical or other shapes, without departing from the scope of the present invention.

Figure 7:
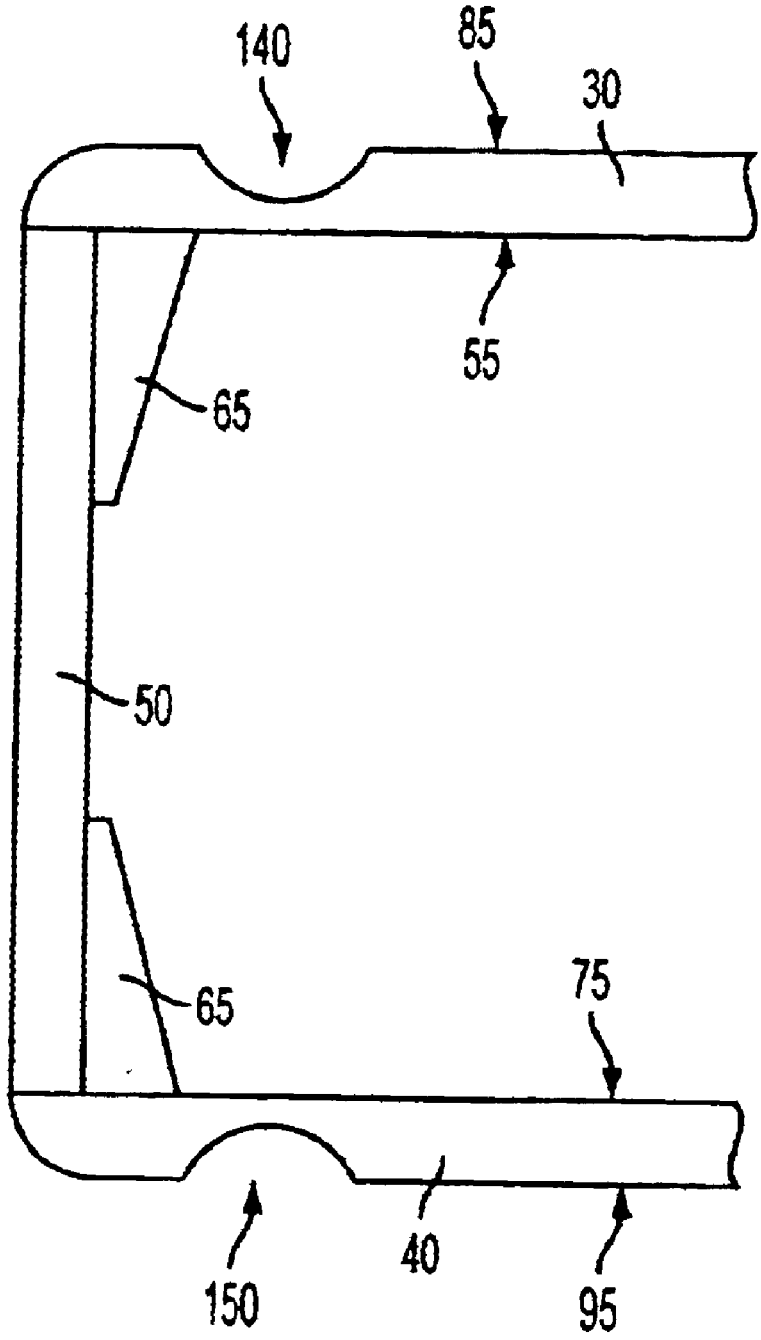
FIG. 7 is an alternative cross-sectional view of FIG. 1 taken along line 1A—1A.

As seen in FIG. 7, according to some embodiments, the soundboard 30 includes a relief cut 140 on its exterior surface 85 and the back wall 40 includes a relief cut 150 on its exterior surface 95. As indicated by the dotted lines 45 in FIGS. 1 and 4, the relief cuts 140,150 preferably extend along the soundboard 30 and back wall, respectively, in close proximity to the sidewall 50. The relief cuts 140,150 preferably have a semicircular cross-section with a uniform area along the soundboard 30.

Thus, it is seen that an improved instrument body is provided. One skilled in the art will appreciate that the present invention can be practiced by other than the preferred embodiments which are presented in this description for purposes of illustration and not of limitation, and the present invention is limited only by the claims that follow. It is noted that equivalents for the particular embodiments discussed in this description may practice the invention as well.

What is claimed is:

1. An acoustic stringed instrument body, comprising:

a soundboard including a relief cut;

a back wall; and a side wall connecting the soundboard and the back wall;

wherein the soundboard includes an interior surface, wherein the relief cut is located on the interior surface.

2. The acoustic stringed instrument body of claim 1, wherein the soundboard includes an exterior surface including another, relief cut.

3. The acoustic stringed instrument body of claim 1, wherein the relief cut is a generally uniform distance from the periphery of the soundboard.

4. The acoustic stringed instrument body of claim 3, wherein the relief cut extends around a portion of the soundboard.

5. The acoustic stringed instrument body of claim 3, wherein the relief cut extends around the entire soundboard.

6. The acoustic stringed instrument body of claim 1, wherein the relief cut has a cross-section chosen from one of the following shapes: semicircular, rectangular, elliptical, square and triangular.

7. The acoustic stringed instrument body of claim 1, wherein the cross-sectional area of the relief cut is uniform.

8. The acoustic stringed instrument body of claim 1, wherein the back wall includes a relief cut.

9. The acoustic stringed instrument body of claim 1, wherein the acoustic stringed instrument is a guitar.

10. The acoustic stringed instrument body of claim 1, wherein the soundboard is made of wood.

11. An acoustic stringed instrument body, comprising:

a soundboard including a relief cut;

a back wall; and a side wall connecting the soundboard and the back wall;

wherein the cross-sectional area of the relief cut is varied.

12. An acoustic stringed instrument body, comprising:

a soundboard;

a back wall; and a side wall connecting the soundboard and the back wall;

wherein the back wall includes an interior surface, wherein the relief cut is located on the interior surface.

13. The acoustic stringed instrument body of claim 8, wherein the back wall includes an exterior surface, wherein the relief cut is located on the exterior surface.

14. A musical instrument soundboard including a relief cut;

wherein the soundboard includes an interior surface, wherein the relief cut is located on the interior surface.

15. The musical instrument soundboard of claim 14, wherein the relief cut is a generally uniform distance from the periphery of the soundboard.

16. The musical instrument soundboard of claim 15, wherein the relief cut extends around a portion of the soundboard.

17. The musical instrument soundboard of claim 15, wherein the relief cut extends around the entire soundboard.

18. The musical instrument soundboard of claim 14, wherein the relief cut has a cross-section chosen from one of the following shapes: semicircular, rectangular, elliptical, square and triangular.

19. The musical instrument soundboard of claim 14, wherein the cross-sectional area of the relief cut is uniform.

20. A musical instrument soundboard including a relief cut; wherein the cross-sectional area of the relief cut is varied.

* * * * *